US005996522A

United States Patent [19]

Merayo

[11] Patent Number: 5,996,522

[45] **Date of Patent: *Dec. 7, 1999**

[54] STORM SAIL FOR SAILBOAT WITH FURLED BOW SAIL

[76] Inventor: Juan Jose Merayo, Comandante Rosales 4011, La Lucila, Pcia. de Bs.As, Argentina

[ * ] Notice: This patent issued on a continued prosecution application filed under 37 CFR 1.53(d), and is subject to the twenty year patent term provisions of 35 U.S.C. 154(a)(2).

[21] Appl. No.: 08/840,594

[22] Filed: Apr. 22, 1997

[30] Foreign Application Priority Data

Apr. 22, 1996 [AR] Argentina ..... 336242

[51] Int. Cl.[6] ..... B63H 9/04

[52] U.S. Cl. ..... 114/102.1; 114/102.15

[58] Field of Search ..... 114/102–107, 102.1, 114/102.13, 102.14, 102.15

[56] References Cited

U.S. PATENT DOCUMENTS 3,147,729 9/1964 Barnard ..... 114/108

FOREIGN PATENT DOCUMENTS 2650805 2/1991 France ..... 114/104

*Primary Examiner*—Jesus D. Sotelo

*Attorney, Agent, or Firm*—Levisohn, Lerner, Berger & Langsam

[57] ABSTRACT

A storm sail for sailboats which replaces a larger bow sail. The storm sail has a smaller area than the replaced bow sail, has a luff forming a rectangular rigging band, which having a width compatible with the replaced bow sail ends in a free edge and has fastening reciprocal means between the free edge and the luff. The storm sail allows the fast and safe replacement of the bow sail and is used when strong winds require a smaller fore sail. When the intensity of the wind increases excessively, the replaceable bow sail is coiled around its own stay and the storm sail is made available, fastening it by its band over the coiled bow sail. When the emergency is over, the storm sail is untied and the bow sail is freed.

4 Claims, 2 Drawing Sheets

$g_d$
a
e
c 7
7'
8
8'
3
2
4
4'
2'
T
1
1'
9
1''
11
5
5'
6
6'

Ge
a
T
2
e
12
12'
c

Ge
10-10'
8
7
8'
3'
4
3
2
9'
2'
4
3'
3
T
3'
4
3
2
1
3'
4
2'
3
4
1''
12
Ge
6'
9
11
5'
12'
e
5-6

STORM SAIL FOR SAILBOAT WITH FURLED BOW SAIL

BRIEF DESCRIPTION OF THE INVENTION

This invention is related to vessels propelled by sail and, particularly, to a new storm sail for sailboats in general.

The objective of this sail is to allow the fast and safe replacement of a bow sail (fore staysail, genoa, storm jib, etc.) with a similar one—having this one a smaller area and greater endurance than the one replaced—especially designed for its fast bend. Consequently, this new sail will be fit to be used in those situations during the sailing, such as strong winds, storms, etc.

As it is well-known, in a sailboat, sails are the means that, fastened to masts or stays, receive the shove of the wind and transmit it to the vessel to be propelled.

In turn, tackles and maneuvers allow the orientation of the set of sails to be reached in an accurate way, and according to direction, aeolian strength and direction followed by the vessel.

It is also well-known that, at least in theory, the more the shove of the wind perpendicularly acts on the sails, the more effective the propelling force will be; even though, in general, this incidence is oblique and, what it is worth noticing is, in fact, the result of the action of the wind on the sails set.

Provided that, commonly, vessels are governed according to the direction selected, the control usually opposes to the direction or changes in the wind direction, the intensity of the waves, and the direction of maritime stream.

Due to the fact that, the magnitude of the aeolian action (taken from the wind center), mainly depends on the sails set area (provided P=S/A; where P: pressure; S: wind strength; A: sails set area), it is obvious that, without being able to modify the strength factor (which depends on nature), the area of the set of sails can be modified.

However, in emergency situations—occurring generally when winds are quite intense, when storms or whirlpools begin—that action can turn against the vessel, provided the intensity and variation of aeolian strengths tend to turn it over to one of its sides.

Under these circumstances, and in order to weather this situation, several resources are usually used:

First resource: to reduce the area of the set of sails—in this case, the bow sail—winding the stay by means of a conventional coiler. The inconvenience is to operate the habitual sail, which is always lighter, facing strong winds and beam changes, which can cause the sail to break when loose or tight.

Second resource: to replace it for others having a smaller area and a greater endurance, such as a storm jib or a tormentin[3].

That is why the equipment of the set of sails of any vessel should be as complete as possible, in order to let it advance with soft breezes, as well as with strong winds. The necessary maneuver involves hauling down the sail to be replaced, untying it from its bend means, and replacing it by the tormentin[3] or storm jib, to which it must be fastened, in order to finally hoist it, enabling its clew, and guiding the sheet itself.

This is the reason why vessels usually have sets of light and storm sails. The most classical ahead sail is the tormentin[3] or storm jib, similar to the fore staysail or the genoa, but having a smaller free area, made in a stronger and more resistant material (in order to be able to face strong aeolian pressures, which in light sail constitutes the first reason of tear).

Precisely, and according to the above mentioned, the new storm or emergency sail, subject matter of this invention, has the advantage of being directly applicable on the replaced sail—which is simply coiled complete on the stay, without disturbing, and which can be made available again once the emergency is over.

On the other hand, the emergency sail involves a faster and easier maneuver than those required for conventional sails—such as that of passing the halyard through its head, using reciprocal couplings on the replaced sail and, fastening the tack and enabling the clew—making it accurate for emergency situations, especially those in which the time to maneuver is noticeably reduced because of weather agents.

Furthermore, said sail is smaller in size than the replaced one (thus satisfying the demand of having a smaller area of aeolian incidence), and it is made of higher resistent material, thus resulting fit for its specific application.

LEECH[1]: free side of a fore-and-aft sail.

SIDE: side of vessel.

BOOM: fore-and-aft sail inferior yard fastened to the mast to haul the main sail aft. The boom is hinged on the main mast, by means of a two-way coupling.

The coupling consists of a vertically-articulated bolt, that can swing horizontally on a "female", braced to the mast by means of a clamp. The whole device is sometimes mounted on a T-track mast rail which permits to raise or lower the boom's bearing along the mast and, occasionally, to haul the sail's foot aft, with the aid of a tackle, that allows the sail to bear the big efforts caused by the couplings in said points: boom gear (and occasionally a roller), collar* of topping lift, of sheet, and of clew. (*Translator's Note: Collar refers to the act of fastening a rope's eye around a bitt, a mast, etc., provided there is not English expression for encapilladura.) The sail bends on the boom in two ways: 1) by means of a longitudinal groove made throughout the upper side of the boom, inside of which the sail foot boltrope is threaded; 2) by means of fairleads hooked in a rail. The outer end of the boom is attached to the mast top by means of a topping lift.

BOOM ROLLER-FURLING: booms rolling on themselves, and used as "chucks" by the sail in order to reduce the cloth area. This system replaces the reefs. In this case, the coupling is assembled on an axis at the end of the boom, and is provided with a gearing operated by means of a crick or a crank. A foremast prevents the boom from unwinding. The topping lift is shackled on a support assembled on the boom axis. The sheet goes fastened or shackled on the other end of the support, and it must be fastened to the boom through a sheath or a "shank" that sorrounds it, without preventing the sheet from rolling on itself. The sheath must be wide enough so that the sail slides without difficulty.

CAPSTAN: device having the shape of a lathe used to trim halyards and sheets, as well as to haul riggings aft. Also known as Winch or "Molinete".

LEECH[2]: lateral side of a fore-and-aft sail extending from the head to the clew. (Translator's Note: in Spanish there are two possible expressions to refer to leech: baluma [1] and calda[2]).

TO TALLY: to haul the sheet aft in order to set the sail more on the vessel's axis. It is also used for reefs.

WIND CENTRE: the resultant of the strengths operating on every sail of a vessel.

SECOND HALYARD: second halyard.

PREVENTER-SHEET: preventer sheet.

CORDAGE: riggings of a vessel.

TO BEND: to rig the sails to their yards, and extensively to the masts, booms, stays or jib stays. The bend is, consequently, a way of rigging of a sail, to any of the elements mentioned.

SHEET: rope to tally and trim sails. Sheets are fastened to the lower free corner of the sails (clew), and allow the sail to be orientated according to the direction of the wind.

FORE STAYSAIL SHEETS OR STORM JIB: they are always divided in two equal ropes fastened to the fore satysail clew, or to the storm jib's clew. Each of these ropes runs to either sides of the boat, passing either on the inside or the outside of the shrouds, depending on the type of vessel, the sail's size or the going. After, it passes through a fixed point (sheet block, fairlead, etc.), before reaching the winch or capstan, or simply to a cleat where it is fastened. While the leeward rope works, the slatch of the other remains slack.

STAY: supports the mast in a fore-and-aft direction, while shrouds hold it abeam.

STAYSAILS: are those that bend on the stays in the strictest sense; fore staysails are also staysails, but the name is generally applied only to the light sails used in ketchs. They are hoisted with their own halyards rigged on the mizzen mast, and are embedded to the deck at the foot of the main mast. These sails are not bent, they are free-foot and free-luff sails.

FORE STAYSAIL: triangular sail on the forward side of the mast, be it a jib, a storm jib, a genoa, a yankee.

LOOP: collar that nooses a rope.

GENOA: for staysail having huge size. Given it great dimensions, the genoa develops a powerful thrust, and reaches it highest performance when is tightened to it maximum, and the halyard is well hauled aft. Otherwise, the sag will make a great deal of the developed strength useless. There are quadrangular genoas having two clews located vertically one above the other. They are difficult to be trimmed.

LUFF: the edge of the sail fastened to the stay or mast. It is the side of the sail located between the head and the tack.

SHACKLE: accessory having the shape of a horseshoe, closed by means of a bolt, used to bind a rope or chain, to an eyebolt, ring, etc.

RIGGING: any rope or cordage playing a role in the tackle of the vessel.

MIZZENMAST: stern mast of vessel, when it is not the mainmast. Sail of said mast.

STORM MIZZEN: the smallest mizzen sail to heave to.

SPRING SHACKLE: jib piston-and-tongue shackles. They should be checked periodically, provided they jam easily. Halyard or sheet clasp or piston shackles. Its use is simple and fast. Clasp shackles are stronger than piston shackles. They tend to replace pin shackles, less practical, but cheaper.

BLOCKS: any pulley or hank where ropes pass through.

JIB STAY: metallic wire running from mast to deck to bend the fore staysail.

In modern sailboats the forestay is used as jib stay.

If the jib stay is not well hauled aft, it makes a "counter-bow" under the fore staysail action, and it loses efficacy.

SHROUD: standing rigging that supports a mast by triangulation.

FOOT: lower side of sail going from tack to clew.

CORNER: sail's angles.

TACK: that by which the sail is fastened to the vessel.

HEAD: that from which the sail is hoisted.

BOLTROPE: rope sewed along the sides of the sails to reinforce them and avoid undue strain and deformations. Frequently, sails bend introducing the boltrope in a groove in the mast, and it is then when the rub can wear the boltrope out. Thus, it is necessary to check the boltrope stitches in corners, and repair them as soon as wear symptoms appear.

REEFS: this is the traditional way in which the sail's area exposed to the wind is reduced. In order to achieve this objective, the reduced sail area is drawn together on the boom and fastened to it by means of small ropes (reefs), that pass the sail through the eye-holes sewed to both sides of the cloth. Reefs are sewed throughout the sail, thus forming the reef band. Once reefed, the sail can still be sheeted taunt and maintain its camber, as long as reef bands are desined slightly convex.

SPINNAKER: an aristocratic sail, the spinnaker (spi for beginners) was in the beginning a racing sail. It is a big triangular fore staysail used with favorable winds. It is manufactured with very light synthetic materials. After, as time went by, it was shaped rounded at the sides, until it became a curvilinear triangle, vertically convex and symmetric.

FOREMAST: mast placed before the mainmast in vessels having more than one mast. Foresail.

STORM JIB: small and strong fore staysail for rough weather.

"TORMENTIN"[3]: storm sail (DN p.399). (Translator's Note: there is no English expression for this word).

SAILS: a piece or a set of pieces stitched together, made of strong canvas or synthetic fiber cloth rigged on yards or booms to catch the wind, and so move a vessel. Sails are made of many sizes and shapes. They are composed of panels stitched together, reinforced on the sides with boltropes and fitted with eyes on the corners to attach them to masts and stays. A sail may also be bent on a yard, depending on the type and rigging of the vessel (DN p.406/441).

Shapes of sails:

The main shape of the sails is triangular (jibs, storm jibs, tormentin[3], etc.)

PARTS OF SAILS:

A) Corners of sails;

The tack: that by which the sail is fastened to the boat.

The head: that by which a sail is hoisted on the mast.

The clew: that on which a rope is fastened to orientate the sail.

Foot: the side between the tack and the clew.

Leech: the side between the tack and the clew.

Luff: the side between the head and the tack.

SET OF SAILS: collection of a vessel's sails.

YARD: a spar on a mast to support the upper side of a square sail.

YANKEE: a narrow jib, whose clew is place in a very high position, thus having its traction point quite backwards.

There are other expressions, which are not herein mentioned, because they are considered very well-known.

BRIEF DESCRIPTION OF THE SEVERAL VIEWS OF THE DRAWINGS

In order to better understand the subject matter of this invention, it is drawn in may figures, only as an illustrative example, without having a limitative character.

On every figure, same numbers refer to equal or corresponding parts, and letters refer to a set of elements.

Figure 3:
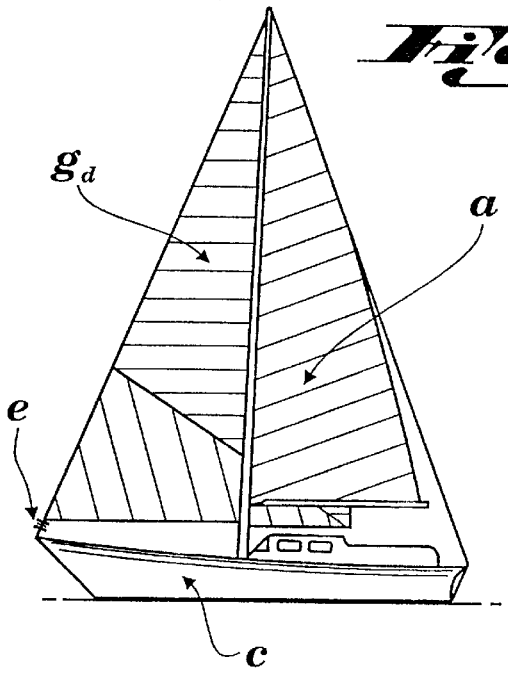
FIG. 3 shows a schematic longitudinal view of a conventional sailboat, with its common set of sails.

LIST OF MAIN REFERENCES:

(a) set of sails (c) hull (e) bow stay ($G_d$) replaceable sail. It is a conventional bow sail (namely, a genoa, a fore staysail, etc.). This reference applies to said sail unfolded, as shown in FIG. 3.

Figure 4:
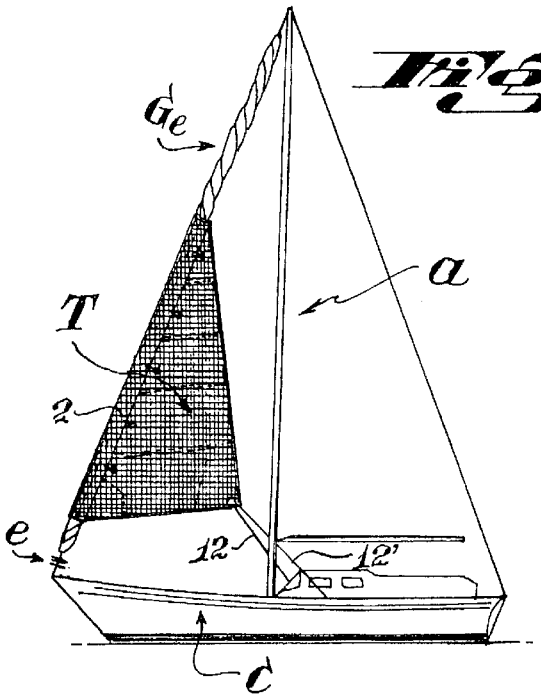
FIG. 4 shows another schematic view of FIG. 3, but having the new storm sail, subject matter of this invention. Said new sail is shown in the figure striped, in order to be easily recognized.
Figure 2:
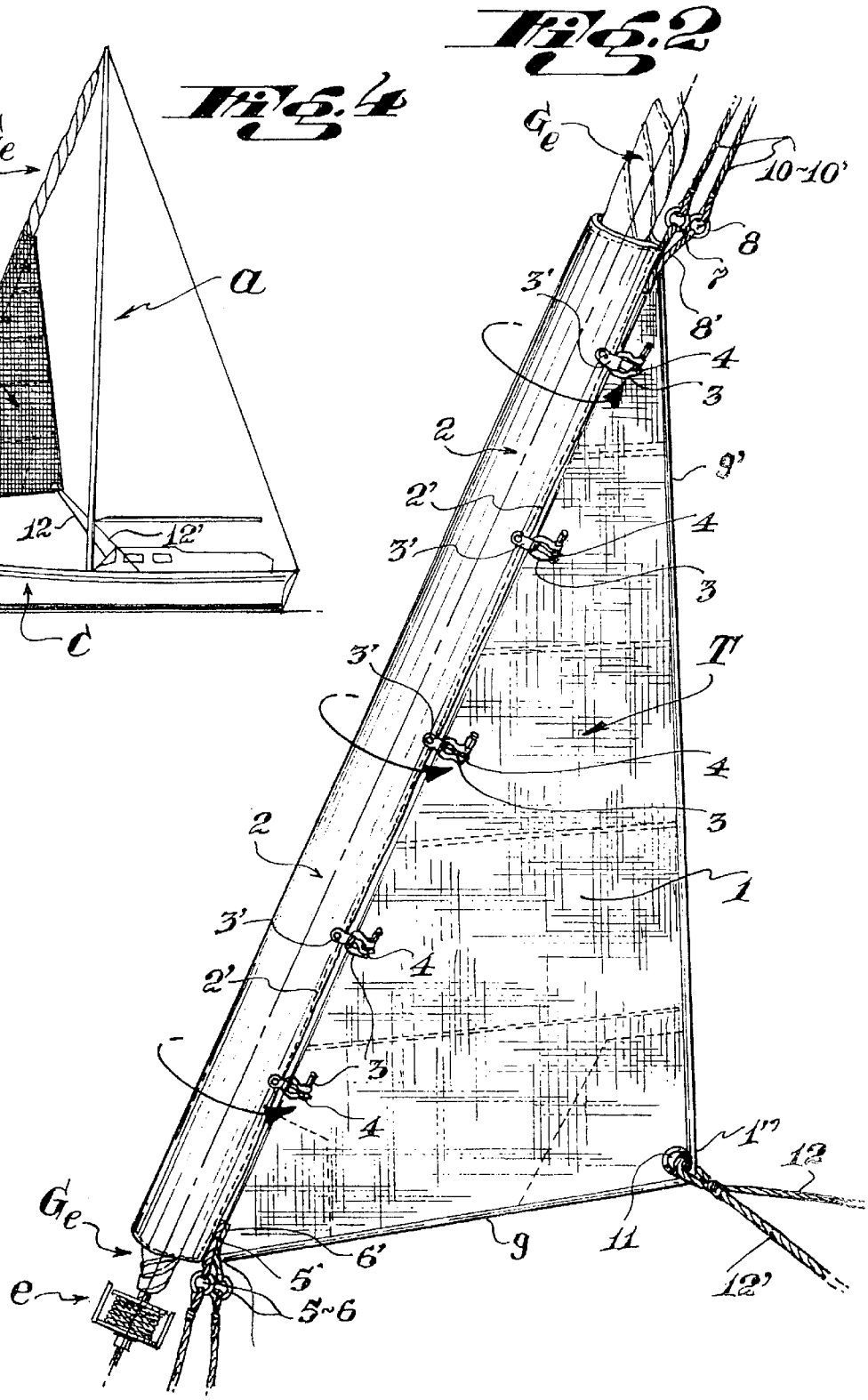
FIG. 2 shows an operative view of the new storm sail already mounted with it band embracing the replaced sail on the stay.

($G_e$) ($G_d$) sail replaced and coiled on its stay, to be used as a hold by the emergency sail (FIGS. 2 and 4).

(T) new storm or emergency sail, subject matter of this invention.

(1) canvas or strong cloth pieces, that joined compose the new storm sail (T).

(1') luff

(1") clew

(2) rigging band (on the replaced coiled sail)

(2') free edge of band (2), attachable to the luff (1')

(3) shackles (or spring shackles)

(3') anchorage band going from shackles (3) to the band (2)

(4) eyelets of (4') for shackles (3). It can be spring shackles, or similar ones.

(4') bands with eyelets.

(5) first eyelet beam.

(5') beam strip on the band (2)

(5')–(6') tack of sail (T)

(6) second eyelet beam

(6') beam strip

(7) ring where the halyard runs through, of the strip (7')

(7') strip of halyard, projected from the band (2)

(7')–(8') head of sail (T)

(8) ring where the halyard runs through, of the strip (8')

(8') strip of halyard, projected from the sail (T)

(9) foot of sail (T)

(9') boltrope of sail (T)

(10) rope of halyard

(10') rope of second halyard

(11) eyelet of sheet

(12) starboard sheet of sail (T)

(12') port preventer sheet of sail (T)

DETAILED DESCRIPTION OF THE INVENTION AND PREFERRED EMBODIMENT

This new storm sail (T) for sailboats in general, being applicable on a replaced ahead sail ($G_e$), coiled on its means of bending, it is composed of stitched pieces of canvas, strong cloth, synthetic fiber, or similar ones forming a triangular whole (1) limited by the sides of the foot (9), leech (9) and luff (1'). The foot (9)'s secured between tacks (5'–6') and clews (12-12'), the leech (9') is secured between heads (7'–8') and clews (12-12'), and the luff (1') is secured between heads (7'–8') and tacks (5'–6'), respectively. Such sail has the peculiarity that, having a smaller area than the replaced one ($G_e$), has a luff (1') extending laterally throughout its length, forming a rigging band (2), which having a width compatible with the replaced sail ($G_e$), ends in a free edge (2'), and has fastening reciprocal means (3–4) between said free edge (2') and said luff (1').

Figure 1:
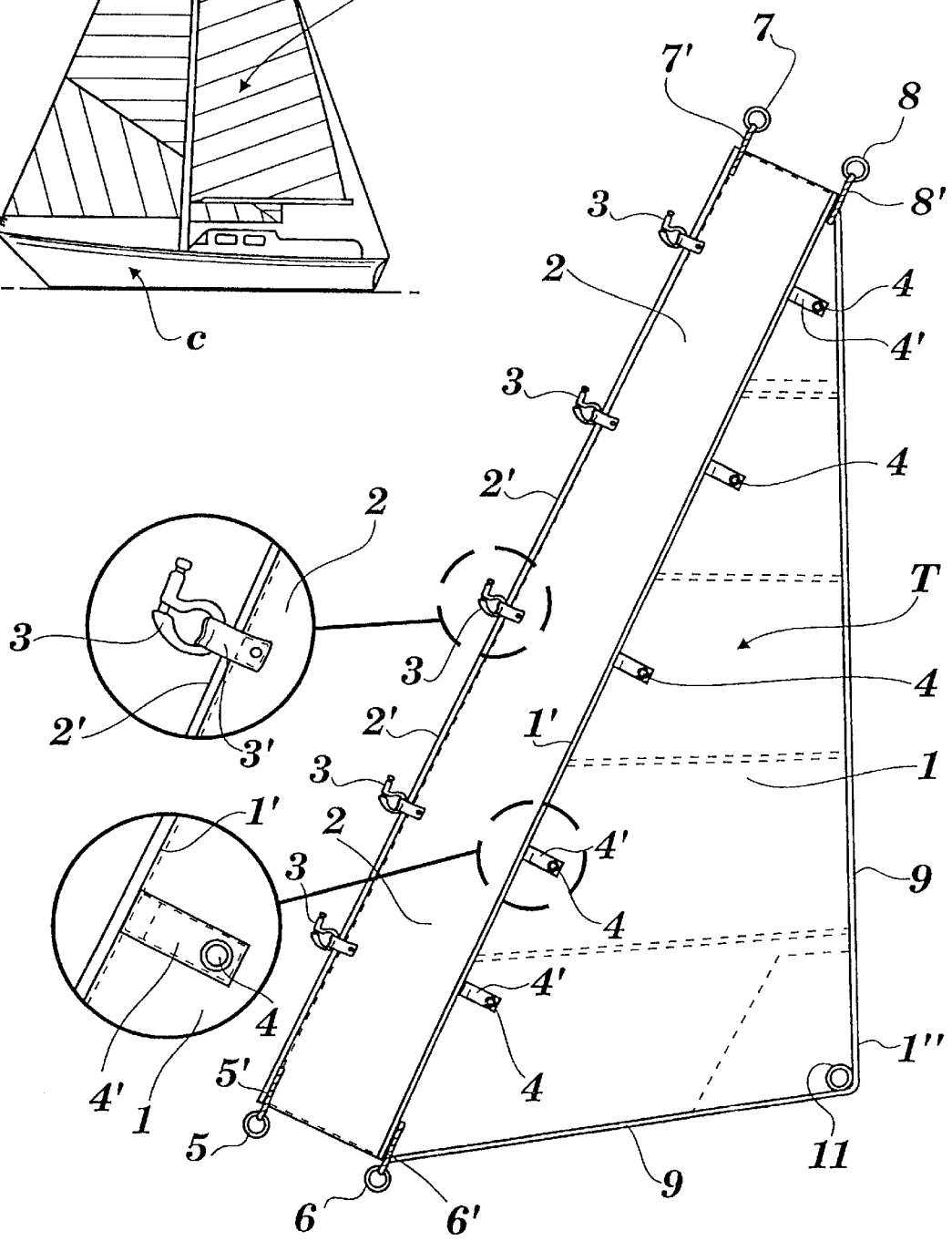
FIG. 1 shows a general view of the new storm sail herein described, that represents a bow sail totally unfolded with its anchorage band, thus appreciating its general structure and layout of the different parts involved. Furthermore, coupling methods such as shackles or spring shackles and eyelets are shown.

In general terms, the vessel to be used with this invention could be of any kind, for instance, those shown in FIGS. 1 and 2, composed essentially of a hull (c) with its set of sails (a). The bow ahead sail can be a fore staysail, a genoa, a "tormentin"[3], or a spinaker, that hoisted, is identified in FIG. 3 with reference ($G_d$), while coiled on its stay (e) is identified with reference ($G_d$), in FIG. 2.

Of course, this ahead sail ($G_d$)—replaceable by the invention—can be bent, or as shown, rigged to stay (e), over which it can be coiled by means of a device like the one shown in FIG. 2, on its left lower area.

The new storm or emergency sail (T) shown in FIG. 1 consists of a set of pieces (1) made of canvas or a strong cloth, adequately stitched, thus reaching an area slightly smaller than the replaced sail ($G_d$).

Furthermore, said sail (T) (with boltropes, or not) is limited by a lower side, the foot (9)—between the tack (5'–6') and the clew (1")—, an edge, the boltrope (9')—between the clew (1") and the head (7'–8')—, and a side, the luff (1')—between the head (7'–8') and the tack (5'–6').

The clew (1") has an eyelet (11) through which a rope passes forming a loop, whose sections define both beams: one corresponding to the port sheet (12'), and the other one corresponding to the starboard preventer-sheet (12), FIG. 2.

The luff side (1') extends laterally forming a rigging band (2), having rectangular shape, and a width compatible with the replaceable coiled said ($G_e$); together with reciprocal fastening means provided in a numerical set, beginning at the luff (1') and from the longitudinal edge (2'), where said band (2) ends.

One of said edges has strips (4') with eyelets (4), while on the opposed edge there are shackles (3), or spring shackles.

Coupling means such as spring shackles (3) can have a free edge (2'), while strips (4') with eyelets (4) are projected from the luff (1'), as shown in FIGS. 1 and 2. However, the provision and layout of such elements can be inverse, namely, the shackles or spring shackles (3) arranged from the luff (1'), and the strips with eyelets (4-4') projected from the free edge (2'). And , even they can be alternated on the same line, a shackle (3) with a strip with eyelets (4-4') on one hand, and a strip with eyelets (4-4') followed by a shackle (3) on the other. (Not illustrated).

From the corners of the lower edge corresponding to the band (2), strips (5') and (6') are projected which, when closing, they define the tack (5'–6'), passing the beam ropes through its eyelets (5 and 6) (FIG. 2); while on the upper opposed side (FIG. 1), the same band projects two other strips (7' and 8') with rings or eyelets (7 and 8) to help run the halyard rope and the second halyard (10 and 10').

Regularly, the vessel is provided with a light set of sails, comprising the replaceable sail ($G_d$), as shown in FIG. 3.

When the intensity of the wind increased excessively, or when a storm begins, it is only necessary to coil said replaceable sail ($G_d$) around its own stay (e) by means of a conventional device, after which the new sail is made available (T), fastening it by its band (2), over the coiled sail ($G_e$), securing the fastening mooring of said sail (T) by means of elements (3) and (4). On the other hand, halyards and second halyard (10-10') are passed through, tack ropes (5'–6') are fastened, and those of the clew (12-12') are oriented, being the new storm sail ready to be used.

Once the emergency is over, the emergency sail is untied (T), repeating the operative process inversely, and freeing the conventional sail ($G_e$) to be hoisted according to FIG. 3.

Undoubtedly, once this new model is put into practice, certain changes regarding shape and built might be introduced, without misunderstanding the main principles clearly set forth in the following clauses:

I claim:

1. A storm sail for a sail boat for use during high winds in lieu of a bow sail, said bow sail when not deployed being furled on a bow support stay, said storm sail comprising a basically triangular surface area smaller than said bow sail when deployed, said storm sail having luff, leech, and foot edges and tack, clew and head portions, said storm sail further comprising a rigging band portion, which is defined by said luff edge, a distance of said leech and said foot edges extending from said head and tack portions toward said clew portion, and a luff-securing line, basically parallel to said luff edge, said distance being slightly greater than the circumference of said bow sail when furled on its bow support stay, said storm sail further comprising luff edge-securing means on said luff edge for securing said luff edge to said luff-securing line and for securing said rigging band around said furled bow sail and bow support stay in an aerodynamically streamlined manner.

2. A storm sail for a sail boat for use during high winds in lieu of a bow sail, according to claim 1 wherein said bow sail is a genoa sail.

3. A storm sail as claimed in claim 1 wherein said luff edge-securing means comprises two or more quick-connect shankling mechanim.

4. A storm sail as claimed in claim 1 wherein said head portion is provided with two loops for facilitating hoisting and lowering of said storm sail by a halyard means.

* * * * *